US010568790B2

(12) United States Patent
Jahkel et al.

(10) Patent No.: US 10,568,790 B2
(45) Date of Patent: Feb. 25, 2020

(54) TILT ASSEMBLY FOR A POWERED WHEELCHAIR AND A POWERED WHEELCHAIR COMPRISING THE SAME

(71) Applicant: Permobil AB, Timrå (SE)

(72) Inventors: Jonas Jahkel, Stockholm (SE); Mehdi Mirzaie, Brentwood, TN (US)

(73) Assignee: PERMOBIL AB (SE)

( * ) Notice: Subject to any disclaimer, the term of this patent is extended or adjusted under 35 U.S.C. 154(b) by 0 days.

(21) Appl. No.: 15/922,704

(22) Filed: Mar. 15, 2018

(65) Prior Publication Data

US 2018/0280215 A1 Oct. 4, 2018

(30) Foreign Application Priority Data

Mar. 31, 2017 (EP) ..... 17164109

(51) Int. Cl.
*A61G 5/10* (2006.01)
*A61G 5/04* (2013.01)

(52) U.S. Cl.
CPC ..... *A61G 5/104* (2013.01); *A61G 5/1059* (2013.01); *A61G 5/1075* (2013.01); *A61G 5/04* (2013.01)

(58) Field of Classification Search
CPC .... A63G 5/1075; A63G 5/1059; A47C 1/024; A47C 1/0242
See application file for complete search history.

(56) References Cited

U.S. PATENT DOCUMENTS 4,884,841 A * 12/1989 Holley ..... A61G 5/14 297/331
5,076,602 A * 12/1991 Robertson ..... A61G 5/00 280/250.1

(Continued)

FOREIGN PATENT DOCUMENTS

DE 29507154 U1 * 8/1995 ..... A61G 5/00
DE 102005020914 B3 * 3/2006 ..... A61G 5/006

(Continued)

OTHER PUBLICATIONS

"Elongated" definition from Merriam Webster internet dictionary; retrieved from https://www.merriam-webster.com/dictionary/elongated on Jul. 31, 2019 (Year: 2019).*

(Continued)

*Primary Examiner* — James A Shriver, II
*Assistant Examiner* — Steve Clemmons
(74) *Attorney, Agent, or Firm* — McAndrews, Held & Malloy, Ltd.

(57) ABSTRACT

The present disclosure relates to a tilt assembly (1) for a powered wheelchair (15), comprising: an elongated base member (3) provided with an axial channel, a lifting member (5) configured to be received by the base member (3) and to move rectilinearly in the channel, between a retracted position and an extended position relative to the base member (3), a tilt frame (7) pivotally connected to the lifting member (5), the tilt frame (7) being configured for mounting a seat assembly (21) thereto, and an arm (9) pivotally connected to the base member (5) and to the tilt frame (7), wherein the tilt frame (7) is configured to obtain a perpendicular orientation relative to a central axis (11) of the lifting member (5) when the lifting member (5) is in the retracted position and to be inclined relative to the central axis (11) when the lifting (Continued)

member (5) is in the extended position, to thereby provide a tilt functionality.

13 Claims, 2 Drawing Sheets

(56) References Cited

U.S. PATENT DOCUMENTS 6,322,250 B1 * 11/2001 Pratt ..... A61B 6/04 280/250.1
6,447,064 B1 * 9/2002 Mundy ..... A61G 5/00 297/313
8,919,797 B2 * 12/2014 Lowenthal ..... A61G 5/1043 280/250.1
10,092,467 B2 * 10/2018 Mackert ..... A61G 5/1059
2007/0102615 A1 * 5/2007 Engman ..... A61G 5/1075 248/371
2008/0106060 A1 * 5/2008 Knopf ..... A61G 5/02 280/250.1
2019/0125599 A1 * 5/2019 Mulhern ..... A61G 5/1059

FOREIGN PATENT DOCUMENTS

EP 1273282 A2 * 1/2003 ..... A61G 5/1059
EP 2823796 A1 1/2015
WO WO-03017883 A1 * 3/2003 ..... A47C 9/002

OTHER PUBLICATIONS

European Search Report for Application No. EP 17164109.5 dated Aug. 23, 2017, 7 Pages.

* cited by examiner

TILT ASSEMBLY FOR A POWERED WHEELCHAIR AND A POWERED WHEELCHAIR COMPRISING THE SAME

CROSS-REFERENCE TO RELATED APPLICATIONS/INCORPORATION BY REFERENCE

The present application claims priority to European Patent Application No. 17164109.5, filed Mar. 31, 2017. The content of the above-identified application is hereby incorporated herein by reference in its entirety.

TECHNICAL FIELD

The present disclosure generally relates to a tilt assembly for a powered wheelchair. In particular, it relates to a tilt assembly which is configured to provide tilting of a seat assembly of a powered wheelchair, and to a powered wheelchair.

BACKGROUND

Powered wheelchairs are commonly fitted with a tilt/lift arrangement which allows adjustment of the orientation and/or the height of the wheelchair seat. Such adjustment may be anterior, i.e. forward, or posterior, i.e. backwards tilting, and/or lifting of the seat. Commonly, tilting is referred to as the operation that affects the orientation of the seat while lifting affects the height of the seat. A seat occupant or caretaker may thereby for example set the seat position according to desire or current need of the occupant. Some examples of reasons for adjusting the seat position include achieving pressure relief, resting in general, the ability to better reach things or otherwise accommodate to the environment. Moreover, adjustment of the seat height and orientation may be a desirable feature for control purposes to stabilise the wheelchair depending on speed and travel on inclined surfaces.

An example of a wheelchair with tilt and lift capabilities is disclosed in EP2823796 A1. The powered wheelchair comprises a chassis frame, a lift device having a base member which is fixedly arranged to the chassis frame, and a lifting member arranged to move rectilinearly relative to the base member along an axis defined by a longitudinal extension of the lifting member, a tilt frame, a first arm pivotally coupled to the lifting member and the tilt frame, and a second arm coupled to the base member, and which second arm is pivotally coupled to the first arm forming a pivot connection, wherein movement of the lifting member towards the extended position moves the pivot connection towards the base member and movement of the lifting member towards the retracted position moves the pivot connection away from the base member.

US6447064 B1 discloses a wheelchair with a tiltable seat. The wheelchair has a tilt fulcrum between 3 and 7 inches from the front edge of the seat pan and between 1 and 4 inches below the surface of the seat pan. This minimizes the elevation of the rider's knees when in a tilted position, and allows for more stability and a shorter wheel base. Manual self-tilting is facilitated by a gas strut arrangement disposed on brackets below the seat pan, and operated by a rider-controlled valve.

SUMMARY

In the case of US6447064 B1, the elevation of the knees is minimised during tilting, because the gas strut is retracted to obtain a tilt position. The tilt frame is arranged horizontal when the gas strut is extended. This wheelchair is a manual wheelchair, which allows a design which lowers the back edge of the tilt frame to perform tilt. Powered wheelchairs on the other hand typically have batteries arranged below the seat limiting the amount of space available for tilt operations. This essentially renders implementation of the tilt functionality as disclosed in US6447064 B1 impossible.

The tilt and lift functionality of EP2823796 A1 provides an anterior/posterior tilt functionality for a powered wheelchair, but has a rather complex design.

In view of the above, a general object of the present disclosure is to provide a tilt assembly which solves or at least mitigates the problems of the prior art.

According to a first aspect of the present disclosure there is provided a tilt assembly for a powered wheelchair, comprising: an elongated base member provided with an axial channel, a lifting member configured to be received by the base member and to move rectilinearly in the channel, between a retracted position and an extended position relative to the base member, a tilt frame pivotally connected to the lifting member, the tilt frame being configured for mounting a seat assembly thereto, and an arm pivotally connected to the base member and to the tilt frame, wherein the tilt frame is configured to obtain a perpendicular orientation relative to a central axis of the lifting member when the lifting member is in the retracted position and to be inclined relative to the central axis when the lifting member is in the extended position, to thereby provide a tilt functionality.

An effect which may be obtainable thereby is a simple tilt function design which during tilt provides a negligible change of the point of gravity of a wheelchair occupant, resulting in good stability of a powered wheelchair during tilt.

According to one embodiment the base member is configured to be immovably mounted to a chassis frame of a powered wheelchair.

According to one embodiment the arm has a first end which is pivotally connected to the base member and a second end which is pivotally connected to the tilt frame.

According to one embodiment the tilt frame has an essentially planar surface configured for mounting a seat assembly of a powered wheelchair thereto.

According to one embodiment the pivot connection between the lifting member and the tilt frame is aligned with a central axis of the lifting member.

According to one embodiment the arm is configured to provide a controlled degree of tilt per height unit of movement of the lifting member. The arm hence controls the tilt motion of the tilt frame, due to its pivotal connection to both the base member and to the tilt frame.

According to one embodiment the arm comprises a linkage member. The arm may be formed of a single or a plurality of linkage members.

According to one embodiment the arm comprises an actuator. The arm may be an actuator configured to be set in a retracted actuator position and an extended actuator position to thereby control the distance between the pivot connection formed between the arm and the tilt frame and the pivot connection formed between the arm and the base member. As a result, more advanced tilting options may be provided, for example both posterior and anterior tilt, and even a lift functionality, using only a few components.

One embodiment comprises a resilient member configured to provide damping of the tilt frame. The damping effect will typically be larger when the lifting member is in the retracted position compared to when the lifting member is in the extended position. This is because in the former case the longitudinal axis of the arm and thus the resilient axis of the resilient member is at an acute angle with the tilt frame, while in the latter case, the same angle is closer to 90° degrees, which makes the lever arm for the force acting on the resilient member larger. When the force needed to compress the resilient member is larger a lesser degree of dampening will occur. Mainly, the dampening effect is desired when driving the wheelchair in normal position, i.e. with the tilt frame in a horizontal, non-tilted position. Thus, due to the design of the tilt assembly the shock absorption/damping capability of the resilient member is largest when in the non-tilted position.

According to one embodiment the resilient member is a spring.

The arm and the resilient member may according to one variation of the tilt assembly form a strut.

There is according to a second aspect of the present disclosure provided a powered wheelchair comprising: a chassis frame, and a tilt assembly according to the first aspect presented herein.

According to one embodiment the base member is immovably mounted to the chassis frame.

According to one embodiment the base member has a central axis which is oriented vertically when the powered wheelchair is arranged horizontally on a planar surface.

One embodiment comprises a seat assembly, wherein the seat assembly is mounted to the tilt frame.

Generally, all terms used in the claims are to be interpreted according to their ordinary meaning in the technical field, unless explicitly defined otherwise herein. All references to "a/an/the element, apparatus, component, means, etc. are to be interpreted openly as referring to at least one instance of the element, apparatus, component, means, etc., unless explicitly stated otherwise.

BRIEF DESCRIPTION OF THE DRAWINGS

The specific embodiments of the inventive concept will now be described, by way of example, with reference to the accompanying drawings, in which.

DETAILED DESCRIPTION

The inventive concept will now be described more fully hereinafter with reference to the accompanying drawings, in which exemplifying embodiments are shown. The inventive concept may, however, be embodied in many different forms and should not be construed as limited to the embodiments set forth herein; rather, these embodiments are provided by way of example so that this disclosure will be thorough and complete, and will fully convey the scope of the inventive concept to those skilled in the art. Like numbers refer to like elements throughout the description.

Figure 1:
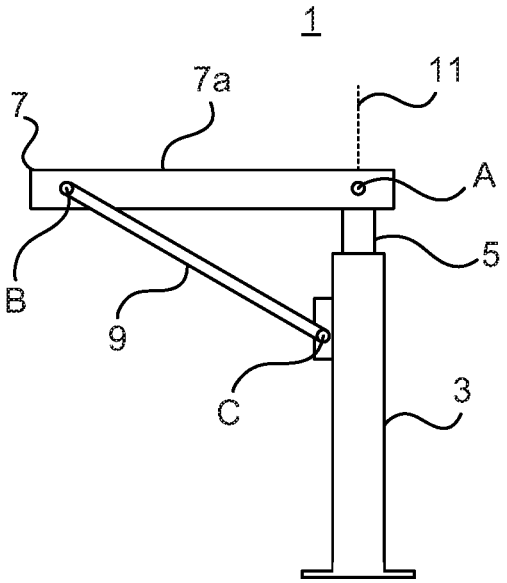
FIG. 1 schematically shows a side view of an example of tilt assembly in a non-tilting position.

FIG. 1 shows an example of a tilt assembly 1 for a powered wheelchair, in a non-tilting position or state. The tilt assembly 1 comprises an elongated base member 3, a lifting member 5, a tilt frame 7 and an arm 9.

The base member 3 is configured to receive the lifting member 5. Hereto, the base member 3 is provided with an axial channel in which the lifting member 5 is configured to be received. The lifting member 5 is configured to move rectilinearly relative to the base member 3, in the axial channel, between a retracted position relative to the base member and an extended position relative to the base member 3. The lifting member 5 and the base member 3 are hence concentrically arranged. In the retracted position, a the lifting member 5 is received maximally by the base member 3, as shown in FIG. 1. In this case, the lifting member 5 is not able to be received further by the base member 3. In the extended position, the lifting member 5 extends or protrudes from the base member 3 more than it does in the retracted position.

The lifting member 5 may according to one variation be configured to be actuated between the retracted position and an extended position by means of a motor.

The base member 3 may according to one variation be configured to be immovably attached or mounted to a chassis frame of a powered wheelchair. The base member 3 is in this case, when mounted to the chassis frame, immovably arranged relative to the chassis frame.

The base member 3 is arranged to extend in a vertical plane when the tilt assembly 1 is mounted to a chassis frame and the powered wheelchair is placed on a horizontal support surface.

The tilt frame 7 is configured to allow a seat assembly to be mounted to the tilt frame 7. The tilt frame 7 is provided with an essentially planar surface, or a planar surface, 7*a* to which a seat assembly may be mounted. This essentially planar or planar surface 7*a* is typically an upper surface of the tilt frame 7. The upper surface is a surface which faces away from the base member 3 and the lifting member 5 and which is intersected by a central axis 11 defined by the longitudinal extension of the lifting member 5.

The tilt frame 7 is pivotally connected to the lifting member 5. The tilt frame 7 is hence pivotable relative to the lifting member 5 about a pivot axis formed by the pivot connection A between the tilt frame 7 and the lifting member 5. The pivot connection A allows the tilt frame 7 to be moved relative to the base member 3 when the lifting member 5 is moved between the retracted and extended position.

The arm 9 extends between the base member 3 and the tilt frame 7. The arm 9 is pivotally connected to the tilt frame 7 and to the base member 3. The tilt frame 7 is hence pivotable relative to the arm 9 about a pivot axis formed by the pivot connection B between the arm 9 and the tilt frame 7. Moreover, the arm 9 is pivotable relative to the base member 5 about a pivot axis formed by the pivot connection C between the arm 9 and the base member 5. According to one variation, the pivot connection B forms one end of the arm 9 and the pivot connection C forms the other end of the arm 9.

The tilt frame 7 is according to the variation shown in FIG. 1 arranged asymmetrically relative to the central axis 11. The majority of the tilt frame 7 has an extension on one side of the central axis 11. The pivot connection B between the tilt frame 7 and the arm 9 is located on that side of the central axis 11 on which the majority of the tilt frame 7 extends. The pivot connection A, which defines the pivot connection between the lifting member 5 and the tilt frame 7 is preferably arranged aligned with the central axis 11.

Figure 2:
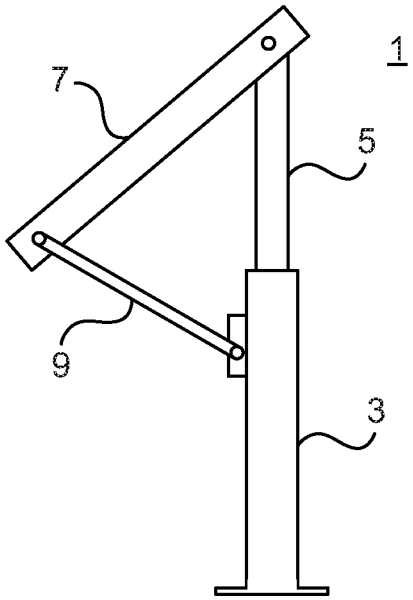
FIG. 2 schematically shows a side view of the tilt assembly in FIG. 1 in a tilting position.

In the non-tilting position of the tilt assembly 1 shown in FIG. 1, no tilt is provided by the tilt assembly 1. FIG. 2 shows the tilt assembly 1 in a tilting position or state. The tilt assembly 1 is configured to provide a posterior or backwards tilt functionality. This means that when the tilt assembly 1 is mounted to a chassis frame, the pivot connection A is located closer to the front end of the chassis frame than the pivot connection B irrespective of whether the tilt assembly is in a tilting or a non-tilting position. To this end, when mounted to a powered wheelchair, the pivot connection A is located closer to the front end of the powered wheelchair than the pivot connection B.

Tilting is provided by movement of the lifting member 5 from its retracted position relative to the base member 3, as shown in FIG. 1, to an extended position relative to the base member 3, as shown in FIG. 2. Movement of the lifting member 5 towards the extended position causes the tilt frame 7 to be moved away from the base member 3. Movement of the lifting member 5 towards the retracted position causes the tilt frame 7 to be moved towards the base member 3. The pivot connection A is translated only rectilinearly when the lifting member 5 is moved between the retracted position and the extended position. In the case of posterior tilting, the pivot connection B is moved along an arc which has a radius defined by the distance between pivot connections B and C when the lifting member 5 is moved between the retracted and an extended position. This movement along the arc contributes to reducing or minimizing the change of the centre of gravity of the user during a tilt operation.

When the lifting member 5 is in the retracted position, the tilt frame 7 is arranged perpendicular to the central axis 11. In particular, the essentially planar surface 7*a* of the tilt frame 7 defines a plane which is arranged perpendicular to the central axis 11 and the central axis 11 intersects this plane. When the lifting member 5 is in an extended position, the tilt frame 7 is inclined relative to the central axis 11. In particular, the essentially planar surface 7*a* is inclined relative to the central axis 11, so that there is an acute angle between the plane and the central axis 11.

The amount of tilt, or the tilt angle, of the tilt frame 7 of an assembled tilt assembly 1 is determined by the amount that the lifting member 5 is moved from the retracted position. The amount of tilt is hence determined by the position of the pivot connection A along the central axis 11. Maximal tilt is provided when the lifting member 5 reaches its maximally extended position relative to the base member 3. No tilt is obtained when the lifting member is maximally retracted into the base member 3.

The arm 9 provides a controlled tilting of the tilt frame 7. The arm 9 provides a controlled degree of tilt per height unit of movement of the lifting member 5. If no arm would be provided, the tilt frame would tilt uncontrollably to obtain a state of posterior tilt or anterior tilt depending on e.g. the centre of gravity and/or the weight of a seat occupant of a seat assembly mounted to the tilt frame. The maximal tilt that can be provided by the tilt assembly 1 is determined by the position of the pivot connection B along the tilt frame 7, the position of the pivot connection C along the base member 3, and on the length of the arm 9.

The arm 9 may for example comprise a single linkage member, as shown in FIGS. 1 and 2 or it may comprise an actuator. In the case of an actuator, the actuator is configured to obtain a retracted actuator position and a fully extended actuator position, and possibly positions in between those end positions. In the fully extended actuator position, the distance between the pivot connections B and C is longer than when the actuator is in the retracted actuator position. Using the actuator, anterior tilting may be provided by, for example, setting the lifting member 5 in the retracted position and setting the actuator in an extended position. Lift functionality may also be obtained by setting the lifting member 5 in an extended position and setting the actuator in an extended position.

Figure 3:
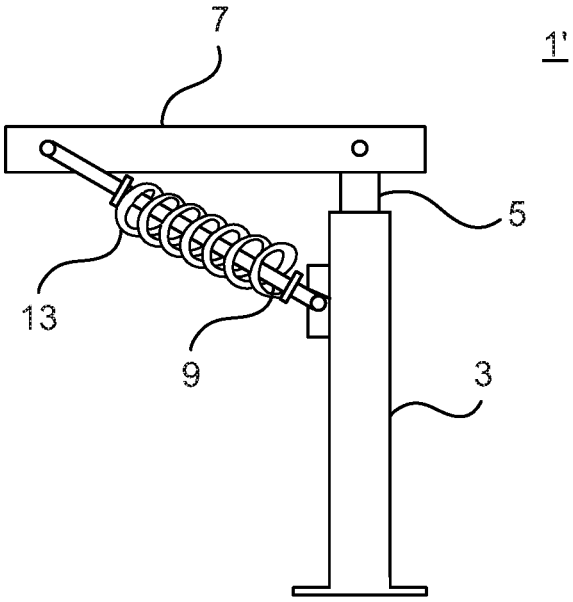
FIG. 3 schematically shows a side view of another example of a tilt assembly.

FIG. 3 shows another example of a tilt assembly. The tilt assembly 1' is essentially identical to the example shown in FIGS. 1 and 2, except that the tilt assembly 1' also comprises a resilient member 13. The resilient member 13 is configured to provide damping of the tilt frame 7. The resilient member 13 may for example be a spring, as exemplified in FIG. 3, in which case the arm 9 and the resilient member 13 may form a strut, or it may be a resilient bushing or a resilient sleeve attached to an end of the arm 9, and which is able to expand and contract in the longitudinal direction of the arm 9. The resilient member 13 may in this case for example be made of a polymeric material.

Figure 4:
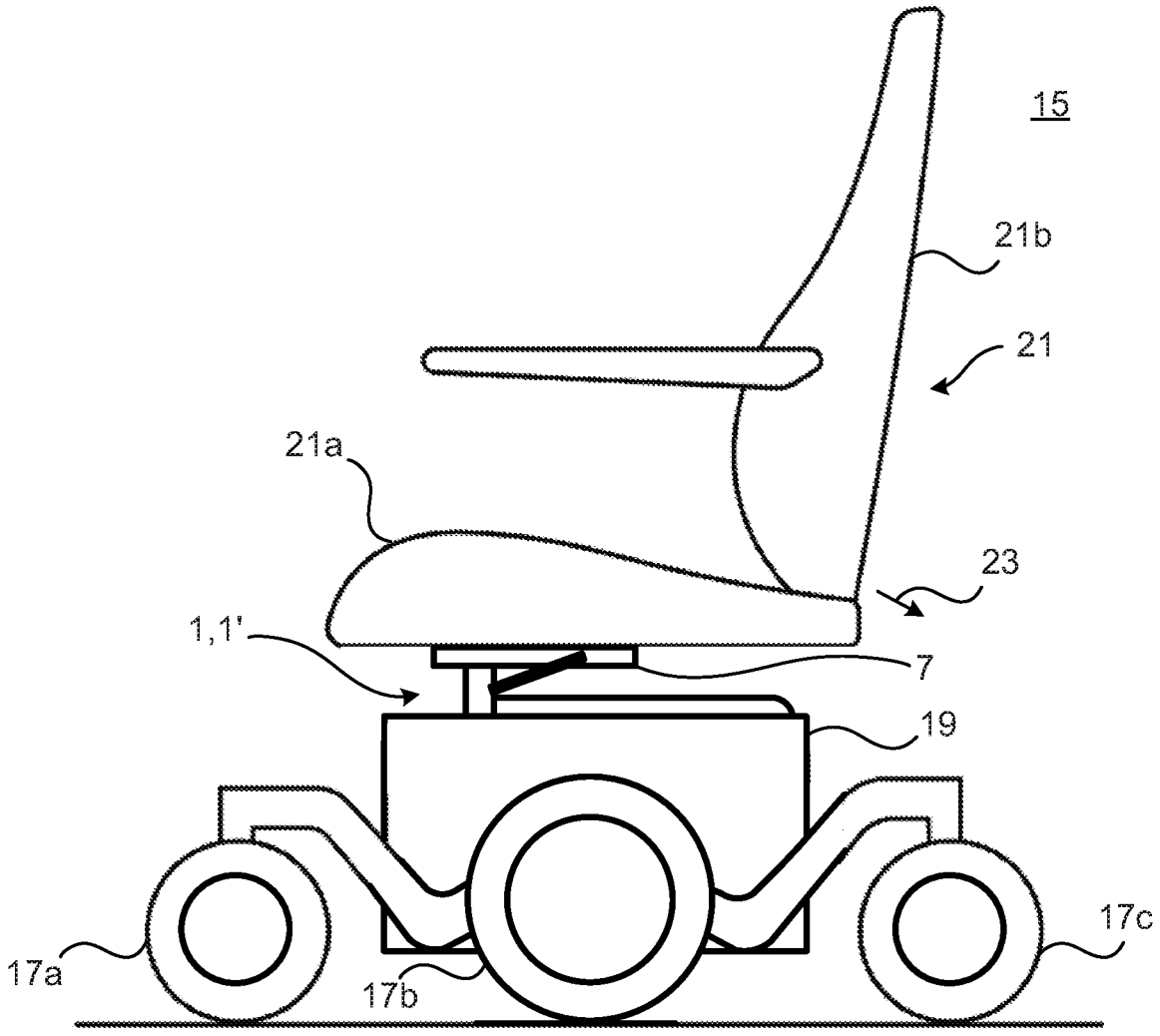
FIG. 4 shows a powered wheelchair comprising the tilt assembly in FIG. 1.

FIG. 4 shows an example of a powered wheelchair 15. The exemplified powered wheelchair 15 is a mid-wheel drive wheelchair, but could alternatively be a front-wheel drive wheelchair or a rear-wheel drive wheelchair.

The powered wheelchair 15 comprises a plurality of wheels 17*a*-17*c*, in the present example two front caster wheels 17*a*, two drive wheels 17*b* and two rear caster wheels 17*c*. The powered wheelchair 15 furthermore comprises a chassis frame 19 on which at least one battery, not shown, is mounted for driving the drive wheels 17*b*, and the tilt assembly 1. The tilt assembly 1 or 1' is mounted to the chassis frame 19. According to the present example, the tilt assembly 1 or 1' is mounted to the chassis frame 19 in front of the at least one battery. The base member 3 is located centred between the two drive wheels 17*b* in a direction from one of the drive wheels 17*b* to the other drive wheel 17*b*.

The powered wheelchair 15 furthermore comprises a seat assembly 21, comprising a seat 21*a* and a backrest 21*b*. The seat assembly 21 is mounted to the tilt frame 7. In particular, the seat assembly 21 is fixedly mounted on top of the tilt frame 7, to the essentially planar surface 7*a* shown in FIG. 1. The tilt assembly 1 or 1' and the seat assembly 21 form a seating system of the powered wheelchair 15.

By moving the lifting member 5 from the retracted position towards an extended position, posterior tilting of the seat system 21 may be provided, as indicated by the arrow 23.

The inventive concept has mainly been described above with reference to a few examples. However, as is readily appreciated by a person skilled in the art, other embodiments than the ones disclosed above are equally possible within the scope of the inventive concept, as defined by the appended claims.

The invention claimed is:

1. A tilt assembly for a powered wheelchair, comprising:

an elongated base member provided with an axial channel, wherein the elongated base member has a central axis which is oriented vertically when the powered wheelchair is arranged horizontally on a planar surface, a lifting member configured to be received by the elongated base member and to move rectilinearly in the channel, between a retracted position and an extended position relative to the elongated base member, a tilt frame pivotally connected to the lifting member, the tilt frame being configured for mounting a seat assembly thereto, and an arm pivotally connected to the elongated base member at a first distance from the central axis and to the tilt frame at a second distance from the central axis, wherein the first distance is less than the second distance when the tilt frame has a perpendicular orientation relative to the central axis, wherein the tilt frame is configured to obtain a perpendicular orientation relative to a central axis of the lifting member when the lifting member is in the retracted position and to be inclined relative to the central axis of the lifting member when the lifting member is in the extended position, to thereby provide a tilt functionality.

2. The tilt assembly of claim 1, wherein the elongated base member is configured to be immovably mounted to a chassis frame of the powered wheelchair.

3. The tilt assembly of claim 1, wherein the arm has a first end which is pivotally connected directly to the elongated base member and a second end which is pivotally connected to the tilt frame.

4. The tilt assembly of claim 1, wherein the tilt frame has an essentially planar surface configured for mounting a seat assembly of the powered wheelchair thereto.

5. The tilt assembly of claim 1, wherein the pivot connection between the lifting member and the tilt frame is aligned with the central axis of the lifting member.

6. The tilt assembly of claim 5, wherein the arm is configured to provide a controlled degree of tilt per height unit of movement of the lifting member.

7. The tilt assembly of claim 1, wherein the arm comprises a linkage member.

8. The tilt assembly of claim 1, wherein the arm comprises an actuator.

9. The tilt assembly of claim 1, comprising a resilient member configured to provide damping of the tilt frame.

10. The tilt assembly of claim 9, wherein the resilient member is a spring.

11. A powered wheelchair comprising:

a chassis frame, and a tilt assembly comprising:

an elongated base member provided with an axial channel, wherein the elongated base member has a central axis which is oriented vertically when the powered wheelchair is arranged horizontally on a planar surface, a lifting member configured to be received by the elongated base member and to move rectilinearly in the channel, between a retracted position and an extended position relative to the elongated base member, a tilt frame pivotally connected to the lifting member, the tilt frame being configured for mounting a seat assembly thereto, and an arm pivotally connected to the elongated base member at a first distance from the central axis and to the tilt frame at a second distance from the central axis, wherein the first distance is less than the second distance when the tilt frame has a perpendicular orientation relative to the central axis, wherein the tilt frame is configured to obtain a perpendicular orientation relative to a central axis of the lifting member when the lifting member is in the retracted position and to be inclined relative to the central axis of the lifting member when the lifting member is in the extended position, to thereby provide a tilt functionality.

12. The powered wheelchair of claim 11, wherein the elongated base member is immovably mounted to the chassis frame.

13. The powered wheelchair of claim 11, comprising a seat assembly, wherein the seat assembly is mounted to the tilt frame.

* * * * *